United States Patent [19]

Colleran et al.

[11] Patent Number: 5,044,991

[45] Date of Patent: Sep. 3, 1991

[54] ELECTRICAL CONNECTOR WITH TERMINAL POSITION ASSURANCE COMPONENT

[75] Inventors: Stephen Colleran, Lisle; Fred L. Krehbiel, Chicago; Bill Wilson, Montgomery, all of Ill.

[73] Assignee: Molex Incorporated, Lisle, Ill.

[21] Appl. No.: 608,782

[22] Filed: Nov. 5, 1990

[51] Int. Cl.[5] ..... H01R 13/40

[52] U.S. Cl. ..... 439/595; 439/274; 439/752

[58] Field of Search ..... 439/274, 595, 744, 752, 439/275, 357, 358, 701

[56] References Cited

U.S. PATENT DOCUMENTS

| | | | |
|---|---|---|---|
| 4,776,813 | 10/1988 | Wilson et al. | 439/595 X |
| 4,944,688 | 7/1990 | Lundergan | 439/595 X |
| 4,944,696 | 7/1990 | Sueyoshi et al. | 439/595 |
| 4,946,398 | 8/1990 | Takenouchi et al. | 439/595 X |
| 4,946,399 | 8/1990 | Kawashima | 439/752 |
| 4,959,023 | 9/1990 | Watanabe et al. | 439/595 |

*Primary Examiner*—Neil Abrams

*Assistant Examiner*—Khiem Nguyen

*Attorney, Agent, or Firm*—Louis A. Hecht; Stephen Z. Weiss; A. A. Tirva

[57] ABSTRACT

An electrical connector is provided with a transversely aligned terminal position assurance (TPA) component that is slidably insertable into a transverse keyway in the connector housing. The TPA component includes a plurality of flexing primary latches and a corresponding plurality of static secondary locks. The flexing primary latches are disposed to align with the terminal receiving cavities of the housing when the TPA component is in a pre-load position. The terminals can be inserted into the housing with the TPA component in this pre-load position such that the flexing primary latches at least temporarily retain the terminals in the housing. Upon complete insertion of all terminals the TPA component is indexed transversely into a final locked position such that the static secondary locks thereof positively engage each terminal to ensure complete insertion. A symmetrical front mating seal is configured to be held in the housing by suction to prevent separation during unmating.

14 Claims, 5 Drawing Sheets

FIG. 1
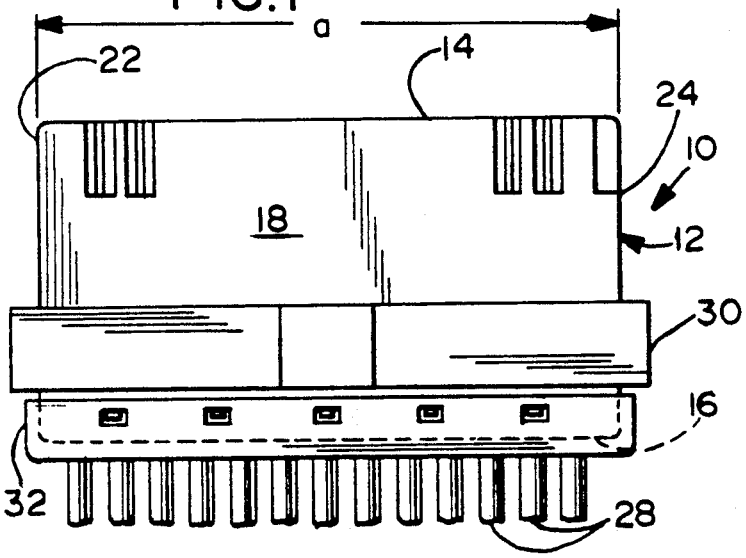
FIG. 3
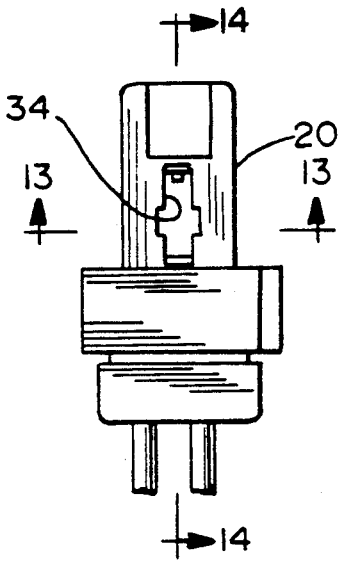
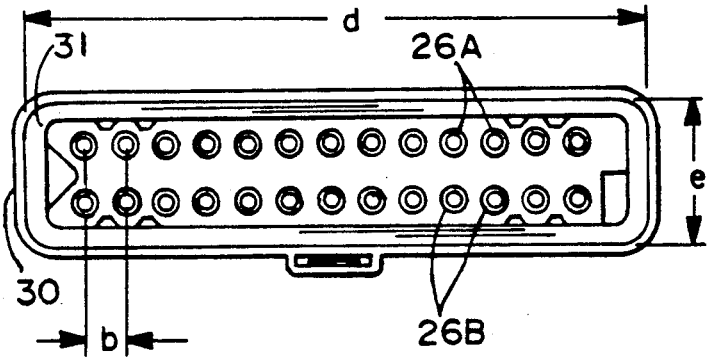
FIG. 2
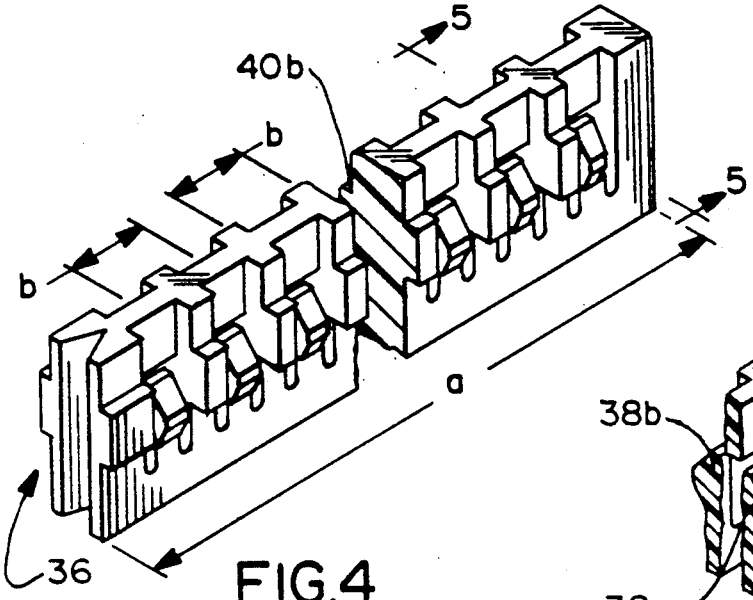
FIG. 4
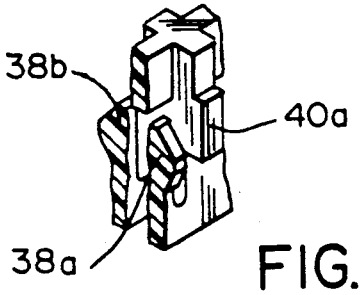
FIG. 5

ELECTRICAL CONNECTOR WITH TERMINAL POSITION ASSURANCE COMPONENT

BACKGROUND OF THE INVENTION

Electrical connectors for automotive applications are incorporated into circuits that monitor and/or control a broad range of vital vehicular functions. For example, steering, suspension and engine operating conditions are continuously monitored on many vehicles. Signals corresponding to sensed operating conditions may be transmitted to displays in the passenger compartment to enable the driver to take appropriate action in response to the displayed information. Other sensed conditions are monitored by on-board controls which automatically alter some aspect of the vehicular performance to compensate for the sensed condition. The electronic circuitry also extends into several nonessential aspects of the vehicle performance, including climate control and sound systems. Vehicular manufacturers must be able to assure that all electronic systems are functioning properly when the vehicle is sold, and that the systems will continue to operate throughout the life of the vehicle.

The electrical connectors incorporated into the circuitry of an automotive vehicle are subjected to extreme environmental conditions, including broad ranges of temperature, exposure to moisture, subjection to almost continuous vibration during use and frequent subjection to direct physical shock. These environmental conditions may cause a terminal in a prior art connector to shift in the connector housing. Terminals of electrical connectors that are not properly inserted in their associated housing or that shift during use may not provide a high quality electrical connection. In an effort to ensure that electrical connectors perform properly, automotive manufacturers require connectors to have terminal position assurance (TPA) components. A TPA component should function to assure that each terminal is fully seated and locked in its connector housing.

Most electrical connectors for automotive applications are manufactured at a first location by an outside vendor, but are assembled and incorporated into the vehicle at a second location. The manufacturers of electrical connectors generally are highly skilled and very familiar with the construction and assembly of their connector, including the TPA component thereof. The assemblers of the connectors may not be as skilled, and generally will not be as familiar with the construction and assembly required for each connector they handle. As a result, there is a potential that a complex electrical connector having several components may be assembled improperly or incompletely. As a result, it is desirable to manufacture electrical connectors to minimize and simplify the amount of component assembly that must be carried out by the vehicular manufacturer.

Most prior art electrical connectors for vehicular applications include a plurality of deflectable locking latches unitarily molded as part of the connector housing. The latches are disposed to extend into the terminal receiving cavities of the housing. The locking latch initially will deflect during insertion of the terminal into the housing. However, upon complete insertion a locking window or other such structure on the terminal will align with the locking latch and will permit the locking latch to resiliently return toward an undeflected condition and into locking engagement with the terminal. These prior art connectors further include TPA components that are urged toward a fully locked position on the housing after the respective terminals have been inserted. The prior art TPA component typically includes a wedge-like projection disposed to extend into a space adjacent the deflectable locking latches of the housing or adjacent the terminals. An inability to fully insert the TPA component will be indicative of an improperly or incompletely inserted terminal. In this regard, complete advancement of the TPA component may be impeded by a deflectable locking latch that has not resiliently returned to an undeflected condition for engagement with the corresponding locking structure on the terminal. Most such prior art TPA components have been constructed to mount to the mating face of the connector and to advance in a direction extending generally parallel to the mating axis. Examples of such prior art connectors are shown in: U.S. Pat. No. 4,557,542 which issued to Coller et al. on Dec. 10, 1985; U.S. Pat. No. 4,714,437 which issued to Dyki on Dec. 22, 1987; and U.S. Pat. No. 4,826,452 which issued to Sian et al. on May 2, 1989. Connectors having TPA components that are mountable to the front mating face of the housing often are considered undesirable in that they limit options for designing the mating interface of pairs of electrical connectors, including environmental seals on the mating face. As will be explained further below, seals are essential for many electrical connectors on automobiles.

A very desirable electrical connector having a rear mounted TPA component is shown in U.S. Pat. No. 4,776,813 which issued to Wilson et al. on Oct. 11, 1988 and which is assigned to the Assignee of the subject invention. The rear mounting of the TPA component, as shown in U.S. Pat. No. 4,776,813, avoids interference between the TPA component and a front seal and/or a mating connector. The connector of U.S. Pat. No. 4,776,813 also is desirable in that the TPA component is locked to the housing in a pre-load condition which enables the terminals to be inserted. After insertion of the terminals the TPA component can be advanced forwardly to a final locked position on the housing which both assures complete seating of the terminals and which holds the locking latches of the housing in engagement with the respective terminals.

Although the connector shown in U.S. Pat. No. 4,776,813 is very effective, it is considered desirable to provide a connector with still further improvements. In this regard, it may be difficult to manipulate a rear-mounted TPA component on connectors having a large number of terminals therein and a correspondingly large number of wires extending from the rear face. It also has been determined that quality control inspections are difficult to complete on connectors having deflectable terminal engaging latches disposed at interior locations on the housing. In particular, injection molding processes create the potential for "short shots" wherein an insufficient amount of molten plastic material is injected into some portion of a mold cavity. These "short shots" can result in some of the internally disposed terminal engaging latches of the housing being either omitted, inoperative or too weak. Terminal engaging latches within the housing make visual quality control very difficult.

Some electrical connectors with a large number of terminals include transversely mountable TPA components. More particularly, prior art connectors of this type have included terminals stamped and formed to include deflectable locking tangs which function as primary locks for engaging a corresponding structure in an associated terminal receiving cavity of the housing. The terminals further include a secondary locking surface or notch in the body of the terminal. The notch is disposed to align with a transversely extending keyway in the housing. A separate TPA component in the form of an elongated solid columnar member is insertable into the cavity of the housing. If the terminals are properly seated in the housing, the TPA component will advance transversely through the keyway to align with and engage the secondary locking surfaces or notches stamped into the terminals. TPA components of this general type prevent interference with seals disposed on either the forward mating face or the rearward wire receiving face of the terminal. Connectors of this type also avoid the interiorly disposed locking latches unitarily molded with the connector housing. Thus, the above described potential for short shots rendering some latches inoperative is completely avoided with connectors of this type. However, these prior art connectors do have some undesirable structural features. For example, the locking latches on the terminal can weaken the terminal and reduce the cross section of metal material for carrying signals from the wire to a mating terminal. Furthermore, the prior art connector of this type requires the transversely mounted TPA component to be separate from the connector housing and inserted only after all of the terminals have been inserted. This requirement imposes an inventory control problem on the vehicular manufacturer and creates the potential for having a TPA component improperly used or not used at all.

Japanese Patent Publication No. 64-45076 shows a connector with a transverse TPA component that is rotatable from a first alignment that permits insertion of terminals to a second alignment that locks the terminals in place. The connector shown in Japanese Patent Publication No. 64-45076 avoids the above described inventory control problems. However, the handle to effect rotation requires excessive space and can be difficult to manipulate.

The TPA components on most prior art connectors are substantially permanently locked in place. Thus, a defect in even one terminal may require replacement of the entire costly connector, with corresponding rewiring costs.

U.S. Pat. No. 4,959,023 issued to Watnabe et al. on Sept. 25, 1990. U.S. Pat. No. 4,959,023 shows an electrical connector having a TPA component received in the front mating end thereof. More particularly, the housing of the connector shown in U.S. Pat. No. 4,959,023 includes a transverse slot extending from the front mating face of the housing substantially entirely across the width of the housing for receiving the TPA component. The front mounted TPA component is indexable in a transverse direction after mounting in the front of the housing. In a first position the TPA component enables insertion of terminals into the housing, but in a second position the TPA component is intended to positively lock the terminals in the housing. In one embodiment of the connector shown in U.S. Pat. No. 4,959,023, the TPA component includes an array of forwardly disposed flexible retainer arms and a second array of rearwardly disposed terminal retaining portions. The forwardly disposed flexible retainer arms are positioned in the housing to engage stamped and formed retainer tongues at forward positions on the terminals when the terminals are fully inserted into the housing. The transverse indexing of the TPA component shown in U.S. Pat. No. 4,959,023 will cause the rearwardly disposed terminal retaining portions thereon to move partly into a rearwardly disposed window on the terminal. As explained above, front mounted TPA components generally are undesirable in that they limit design options for mateable pairs of connectors and may interfere with front mounted seals. Furthermore, an arrangement as shown in U.S. Pat. No. 4,959,023 with a front mountable and transversely indexable TPA component necessarily requires a large slot in the connector housing, thereby making the housing insufficiently sturdy and robust for use in the demanding automotive environment. The forwardly disposed stamped and formed retainer tongue on the terminals required for the connector of U.S. Pat. No. 4,959,023 may further weaken the terminals and will provide a smaller cross-sectional area for carrying signals through the terminal. Additionally, the more rigid terminal retaining portions of the TPA component shown in U.S. Pat. No. 4,959,023 are disposed to only engage one edge region of the terminal thereby providing lower pullout forces and enabling angular shifting of terminals in response to forces imposed upon the wires.

The front seals on electrical connectors typically are of U-shape cross-section. The base of the U-shape seal will seat against a portion of the connector housing. The arms of the U-shaped seal will project forwardly, with the space between the arms being dimensioned to sealingly engage a mating connector. In many situations, friction between the seal and the mating connector will cause the seal to dislodge during unmating. In other situations, the seal may be initially assembled incorrectly, with the arms of the U-shaped cross-section projecting rearwardly. This improper assembly may render the seal ineffective.

In view of the above, it is an object of the subject invention to provide an electrical connector having a transversely extending TPA component that can be mounted in the connector housing prior to insertion of the terminals therein.

Another object of the subject invention is to provide an electrical connector with a transversely mounted TPA component which performs a primary locking function for securely retaining the terminals in the housing.

An additional object of the subject invention is to provide an electrical connector with a TPA component that is alternately lockingly engagable with the housing in a pre-load condition and in a final locked condition.

Still a further object of the subject invention is to provide an electrical connector that can avoid deflectable locking means unitary with the housing and/or unitary with the terminal.

Yet a further object of the subject invention is to provide an electrical connector with transversely mounted TPA means and visually inspectible terminal locking means.

Another object of the invention is to provide a seal that is more securely engaged in the housing.

A further object of the invention is to provide a seal that can not be inserted incorrectly.

SUMMARY OF THE INVENTION

The subject invention is directed to an electrical connector comprising a housing with at least one electrically conductive terminal therein The connector further comprises a terminal position assurance (TPA) component for both ensuring accurate positioning of each terminal and for positively locking each terminal in the electrical connector housing. The TPA component is aligned transversely relative to the mating axis of the connector. The TPA component is further uniquely configured to be preliminarily locked in the electrical connector housing in a pre-load position which permits insertion of the terminals into the housing. The terminals are retained in the housing by the TPA component with sufficient force to prevent accidental separation therefrom. More particularly, the TPA component retains the terminals with sufficient force to enable preliminary optical or electrical testing of the circuits to be carried out. Separation of a defective terminal from the electrical connector housing can be readily achieved with the TPA component in this pre-load condition by using appropriate application tooling.

The TPA component and the electrical connector housing are further constructed to permit the TPA component to be advanced into a final locked position after insertion of all terminals into the electrical connector housing. The movement of the TPA component into its final locked position in the electrical connector housing provides for positive locking of the terminals in the housing with a substantially higher pull-out force than exists when the TPA component is in its pre-load position. An inability to advance the TPA component transversely into the final locked position on the electrical connector housing is indicative of one or more improperly inserted terminals.

The TPA component may be returned from the final locked position to the pre-load position in the electrical connector housing with appropriate application tooling such as a screwdriver or other thin pointed implement. Return of the TPA component to the above described pre-load position enables a defective terminal to be removed from the electrical connector housing as explained above.

The TPA component preferably comprises two locking means which are independently lockable to the housing. The first locking means will retain the TPA component in the pre-load position. The second locking means retains the TPA component in the final locked position. With this construction, the first locking means will prevent complete separation of the TPA component from the housing when a technician is attempting to return the TPA component from the final locked position to the pre-load position.

The TPA component of the subject invention defines an elongated member having a plurality of primary terminal locks or detents formed thereon for preliminarily locking each terminal in the electrical connector housing to prevent accidental separation therefrom. The primary terminal locks or detents may comprise resiliently deflectable latches disposed to extend into their respective terminal receiving cavities of the electrical connector housing when the TPA component is mounted in the pre-load position on the housing. Each latch is disposed and configured to be defected by a corresponding terminal during insertion of the terminal into the terminal receiving cavity of the housing. Upon complete insertion of the terminal into the terminal receiving cavity, the latch of the TPA component will align With a locking notch on the terminal. Thus the latch will resiliently return toward an undeflected condition to achieve an initial retention of the terminal in the housing.

The TPA component further comprises a plurality of secondary terminal locks for more securely engaging each respective terminal and positively retaining the terminals in the housing. The secondary terminal locks of the TPA component may define rigid non-deflectable blocks generally aligned with the latches and disposed and dimensioned to slide into the locking notch formed on each terminal as the TPA component is indexed into the final locked position on the housing and as the respective latches are slid out of the locking notches in the respective terminals.

A plurality of primary and secondary locks may be spaced along the length of the TPA component in alternating relationship to one another. The space between the primary locks may substantially correspond to the pitch between adjacent terminals in the connector. Similarly, the spacing between secondary locks on the TPA component also may be equal to the pitch between the terminals.

The connector of the subject invention achieves several very significant advantages. First, the transverse alignment of the TPA component is well suited to connectors requiring both forward and rearward seals that might otherwise interfere with a TPA component. Furthermore, the transverse alignment of the TPA component is well suited to connectors having a large number of terminals therein where a rear mounted TPA component might interfere with wires extending from the rear end of the connector. Unlike most other prior art transversely mounted TPA components, the TPA component of the subject invention may be securely locked in the pre-load position on the housing which permits insertion of terminals into the terminal receiving cavities. Thus, the connector manufacturer may ship an assembled housing and TPA component to the automobile manufacturer or other component assembler for final insertion of the terminated leads into the housing. Inventory control problems are eliminated entirely. The primary locks of the TPA component provide an efficient means for ensuring that terminals are at least temporarily retained in the electrical connector housing, and for preventing unintended separation of a terminal from a fully seated position while a subsequent terminal is being inserted. The subject connector further avoids the internally disposed locking latches within the connector housing, and thereby avoids the quality control inspection problems referred to above. Additionally, the alignment of the primary latches with the secondary locks of the TPA component greatly simplify the terminal and housing designs with each being more sturdy and robust and hence better suited to use in the automotive environment. The locking means for retaining the TPA component in the housing also permits efficient return of the TPA component from the final locked position to the preload position, while preventing complete separation of the TPA component from the housing. This enables selected defective connectors to be replaced without complete removal of the TPA component and without risking separation of other terminals from the housing. Furthermore the reverse indexing can be completed without interfering with the front mating face or the rearward end of the connector.

The connector of the subject invention further includes front mating seal which is unitarily molded from an elastomeric material. The seal preferably is of symmetrical H-shape cross-section to prevent an improper inverted mounting in the housing. The seal defines a continuous loop which is configured and dimensioned to be under compression when mounted in a continuous channel on the housing. The compression creates a suction between the housing and the rearwardly facing arms of the H-shape seal. The suction retains the seal to the housing and prevents separation during unmating.

BRIEF DESCRIPTION OF THE DRAWINGS

FIG. 1 is a top plan view of a connector in accordance with the subject invention.

FIG. 2 is a front elevational view of the connector.

FIG. 3 is a side elevational view of the connector.

FIG. 4 is a perspective view of a TPA component for the connector shown in FIGS. 1-3.

FIG. 5 is a cross sectional view taken along line 5—5 at FIG. 4.

DETAILED DESCRIPTION OF THE PREFERRED EMBODIMENT

Figure 6:
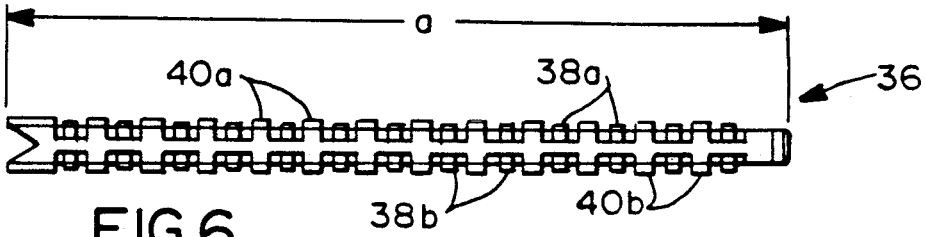
FIG. 6 is a front elevational view of the TPA component.
Figure 7:
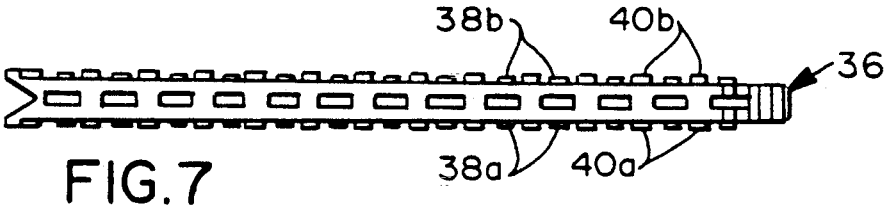
FIG. 7 is a rear elevational view of the TPA component of FIG. 6.
Figure 8:
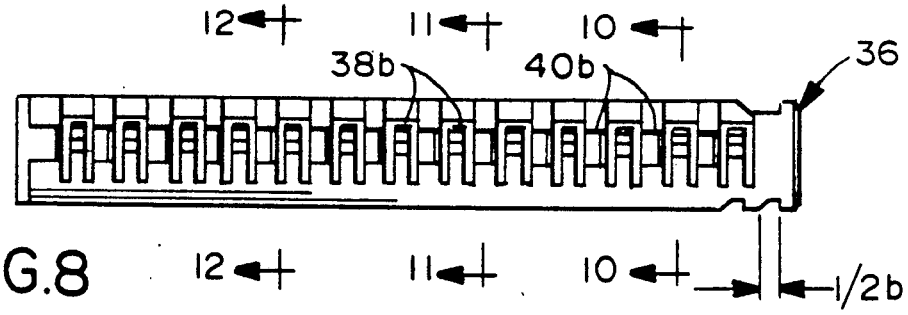
FIG. 8 is a top plan view of the TPA component of FIGS. 6 and 7.
Figure 9:
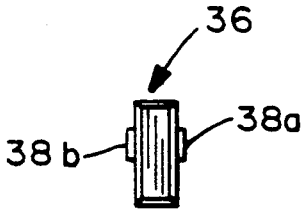
FIG. 9 is an end elevational view of the TPA component of FIGS. 6-8.

An electrical connector in accordance with the subject invention is identified generally by the numeral 10 in FIG. 1 The connector 10 includes a housing 12 that is unitarily molded from a nonconductive material. The housing 12 includes a forward mating end 14 and a rearward end 16. A top and bottom 18 and 20 respectively extend between the forward and rearward ends 14 and 16 of the housing 12, and opposed sides 22 and 24 extend between the forward and rearward ends 14 and 16 and between the top and bottom 18 and 20.

Top and bottom arrays of terminal receiving cavities **26*a* and 26*b* respectively are defined in the housing 12 and extent between the forward and rearward ends 14 and 16 of the housing 12. More particularly, terminal receiving cavities 26*a* in the top array are disposed in proximity to the top 18 of the housing, while the terminal receiving cavities 26*b* in the bottom array are disposed generally adjacent the bottom 20 of the housing. The top array of terminal receiving cavities 26*a* is separated from the bottom array of terminal receiving cavities 26*b* by a transverse wall. Additionally walls extending inwardly from the top 18 and bottom 20 separate the terminal receiving cavities 26*a*, 26*b* from one another. These internal walls contribute substantially to the strength of the housing 12 and make the connector 10 sufficiently robust for use in the physically demanding automotive environment. The terminal receiving cavities 26*a*, 26*b* are dimensioned to receive terminals (not shown) therein such that the discrete wires 28 terminated thereto extend from the rear end 16 of the housing. The distance between terminal receiving cavities 26*a* or between terminal receiving cavities 26*b* is indicated by dimension "b" in FIG. 2**.

A shroud 30 extends outwardly from the housing 12 intermediate the forward and rearward ends 14 and 16 thereof. The shroud defines a forwardly opening channel 31 which receives an elastomeric seal (not shown) therein for sealingly engaging with a mating connector (not shown). The seal is described in greater detail below.

The rearward end 16 of the housing 12 further includes an elastomeric wire seal to surround and sealingly engage the respective wires 28. A wire seal cover 32 is lockingly mounted over the rearward end 16 of the housing 12 to both compress and protect the wire seal.

The provision of both forward and rearward seals substantially limits design options for forwardly or rearwardly mounted TPA components. Furthermore, as noted above, structural requirements of a mating electrical connector further limit design options for a forwardly mounted TPA component, while the large number of wires 28 extending from the rear end 16 of the connector 10 may complicate the manipulation of a rearwardly mounted TPA component. As a result, the housing 12 of the connector 10 is provided with a transverse TPA keyway 34 extending entirely therethrough between the first and second sides 22 and 24 of the housing 12. The keyway 34 is disposed intermediate the top and bottom arrays of terminal receiving cavities **26*a* and 26*b* to communicate with each terminal receiving cavity 26*a*, 26*b*** and the respective terminals inserted therein.

The TPA keyway 34 is dimensioned to slidably and lockably receive a TPA component 36 which is illustrated in greater detail in FIGS. 4-12. The TPA component 36 is an elongated structure defining a length "a" substantially equal to the width of the housing 12. As shown most clearly in FIGS. 4 and 9 the TPA component 36 defines an overall cross-sectional profile substantially conforming to the cross-sectional configuration of the keyway 34 in the housing 12. The TPA component 36 defines a complex cross-sectional configuration along its length comprising an array of spaced apart pairs of flexing primary latches **38*a* and 38*b* disposed to alternate with an array of spaced apart pairs of static secondary locks 40*a* and 40*b*. The pitch or space in between the pairs of flexing primary latches 38*a*, 38*b* and the pitch between the pairs of static secondary locks 40*a*, 40*b* are substantially equal to one another and are further equal to the pitch "b" between adjacent pairs of terminal receiving cavities 26*a* in the upper array or 26*b* in the lower array as illustrated most clearly in FIG. 2. With this arrangement, as explained in greater detail below, the TPA component 36 can be disposed at a first position in the keyway 34 such that the flexing primary latches 38***a* and 38*b* each extend into a corresponding terminal receiving cavity 26*a* and 26*b*. The TPA component 36 may then be indexed a distance equal to one-half the pitch "b" between adjacent terminal receiving cavities 26*a* or 26*b* to achieve alignment of each static secondary lock 40*a* and 40*b* with a corresponding terminal receiving cavity 26*a* or 26*b*.

The cross-sectional configuration of the TPA component 36 is non-symmetrical from front to rear to ensure that the TPA component 36 can be inserted into the keyway 34 with only one angular orientation. Thus, the flexing primary latches 38*a*, 38*b* and the static secondary locks 40*a*, 40*b* are assured of being properly positioned for engagement with the respective terminals inserted into the terminal receiving cavities 26*a* and 26*b* as explained and illustrated further below. The TPA component 36 may be configured such that the flexing primary latches 38*a* and 38*b* will be cantilevered either forwardly or rearwardly in the housing 12. However, a forwardly cantilevered arrangement of the flexing primary latches 38*a* and 38*b* may be preferred in some embodiments, as explained further below, to facilitate the intentional disengagement of the flexing primary latches 38*a* and 38*b* with application tooling to enable removal of a damaged or defective terminal from the housing 12.

Figure 10:
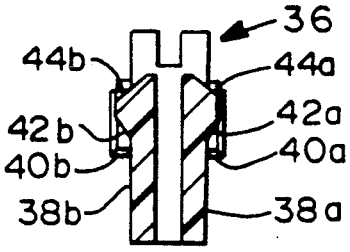
FIG. 10 is a cross sectional view taken along line 10—10 in FIG. 8.
Figure 11:
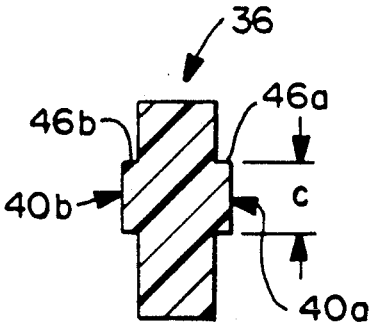
FIG. 11 is a cross sectional view taken along line 11—11 in FIG. 8.
Figure 12:
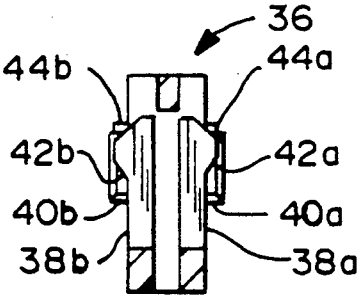
FIG. 12 is a cross sectional view taken along line 12—12 in FIG. 8.

As shown most clearly in FIGS. 10 and 12, each flexing primary latches 38*a*, 38*b* is provided with a rearwardly facing ramped surface 42*a*, 42*b* and a forwardly facing surface 44*a*, 44*b*. The ramped surface functions to deflect the flexing primary latch 38*a*, 38*b* inwardly toward one another upon contact by a terminal being inserted into a corresponding terminal receiving cavity 26*a*, 26*b* of the housing 12. The forwardly facing surface 44*a*, 44*b* is disposed to engage a shoulder of a notch defined in the terminal upon complete insertion of the terminal into the cavity 26*a*, 26*b*. The forwardly facing surface 44*a*, 44*b* may be angularly aligned to the mating axis to define a terminal retaining detent that does not positively lock with the terminal. Alternatively, as shown in broken lines in FIGS. 10, 12 and 17, the forward face of the flexing primary latches 38*a* and 38*b* may be orthogonal to the mating axis to more positively lock with the associated terminal.

The static secondary locks 40*a*, 40*b* define a length "c" and include forwardly facing locking surfaces 46*a*, 46*b* which are disposed generally in register with the forwardmost portion of the forwardly facing engagement surfaces 44*a*, 44*b* on the flexing primary latches 38*a*, 38*b*. Thus, the locking surfaces 46*a*, 46*b* of the static secondary locks 40*a*, 40*b* also are disposed to lockingly engage the same shoulder defined by notch in the associated terminals. The particular surface 44*a*, 44*b* or 46*a*, 46*b* to engage the shoulder of the notch in the terminal will depend upon the particular transverse position of the TPA component 36 in the keyway 34 of the housing 12 as explained further below.

Turning to FIGS. 13–16, the TPA component 36 is lockably engagable in the housing 12 in alternate first and second positions. More particularly, as shown most clearly in FIGS. .4 and 16, the housing 12 is provided with resiliently deflectable first and second TPA locking latches 48 and 50. The first TPA locking latch 48 includes a ramped inwardly facing surface 52 and an outwardly facing locking surface 52 both of which are disposed to extend into the TPA keyway 34 of the housing 12. Similarly, the second TPA latch 50 includes an inwardly facing ramped surface 56 and an outwardly facing locking surface 58 which are disposed to extend into the TPA keyway 34.

The TPA component 36 is formed to include a ramped or chamfered leading edge 60 which will engage the ramped surfaces 52 and 56 of the first and second TPA latches 48 and 50 respectively for generating deflection of the TPA latches 40 and 50 away from one another. The deflection of the TPA latches 48 and 50 will permit further advancement of the TPA component 36 in the keyway 34. The TPA component 36 further includes primary locking surfaces 62 and 64 and a secondary locking surface 66 spaced from the primary locking surface 64 by one-half the pitch "b" between the terminal receiving cavities. A secondary ramped surface 68 disposed between the primary locking surface 64 and the bottom secondary locking surface 66. It will be noted that the TPA component does not include a secondary locking surface in proximity primary locking surface 62.

Upon sufficient advancement of the TPA component 36 into the keyway 34, the primary locking surfaces 62 and 64 thereof will align with the locking surfaces 54 and 58 on the TPA latches 48 and 50 respectively. This relative alignment will permit the TPA latches 48 and 50 to resiliently return toward an undeflected condition such that the locking surfaces 54 and 58 of the TPA latches 40 and 50 will engage with the primary locking surfaces 62 and 64 on the TPA component 36. This engagement will secure the TPA component 36 in a pre-load position in the housing 12 wherein the flexing primary locks 38*a*, 38*b* are aligned with the associated terminal receiving cavities 26*a*, 26*b* as illustrated most clearly in FIG. 13. In this pre-load position, as explained above, terminals may be inserted into the respective terminal receiving cavities 26*a* and 26*b*, or may be removed therefrom with appropriate application tooling.

Figure 15:
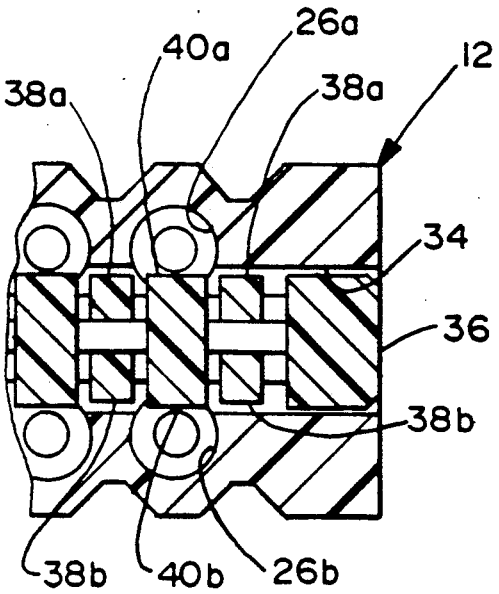
FIG. 15 is a cross sectional view similar to FIG. 13 but showing the TPA component in a second indexed position.

Further advancement or indexing of the TPA component 36 into the keyway 34 will cause the secondary ramp surface 68 of the TPA component 36 to engage the ramped surface 52 of the TPA latch 50. This engagement will cause a second reflection of the TPA latch 50 to permit continued advancement of the TPA component 36. Upon sufficient advancement, the locking surface 58 of the TPA latch 50 will align with the secondary locking surface 68 on the TPA component 26. This again will permit the TPA latch 50 to resiliently return toward an undeflected condition such that the locking surface 58 thereof engages the secondary locking surface 68 on the TPA component 36. In this locked position, the static secondary locks 40*a*, 40*b* will align with and extend into the corresponding terminal receiving cavities 26*a*, *b* as depicted in FIG. 15.

Figure 13:
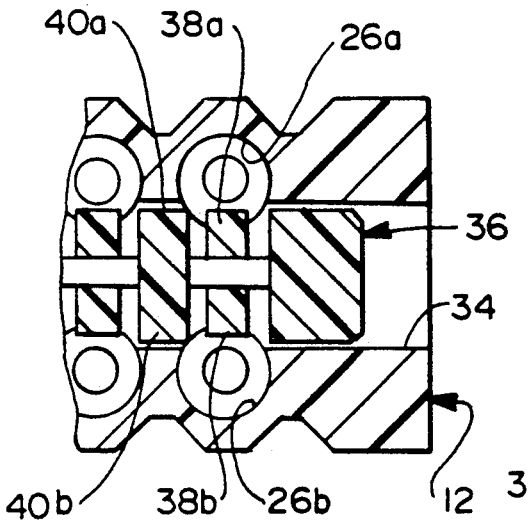
FIG. 13 is a cross sectional view taken along line 13—13 in FIG. 3.
Figure 14:
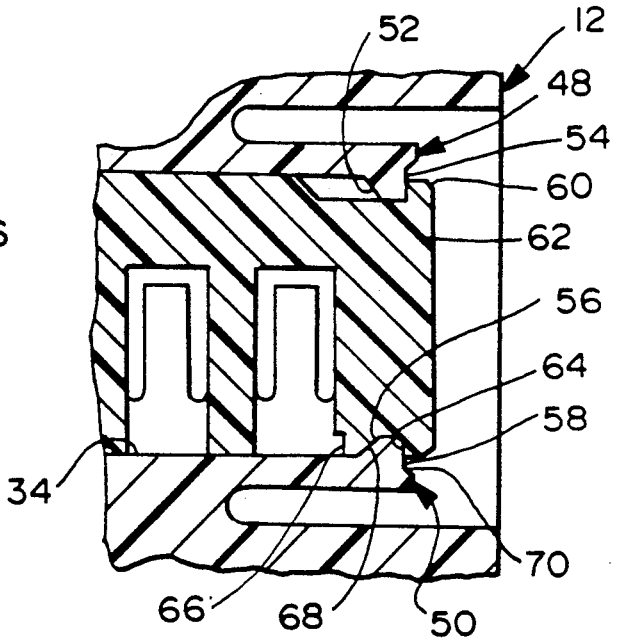
FIG. 14 is a cross sectional view taken along line 14—14 in FIG. 1.
Figure 16:
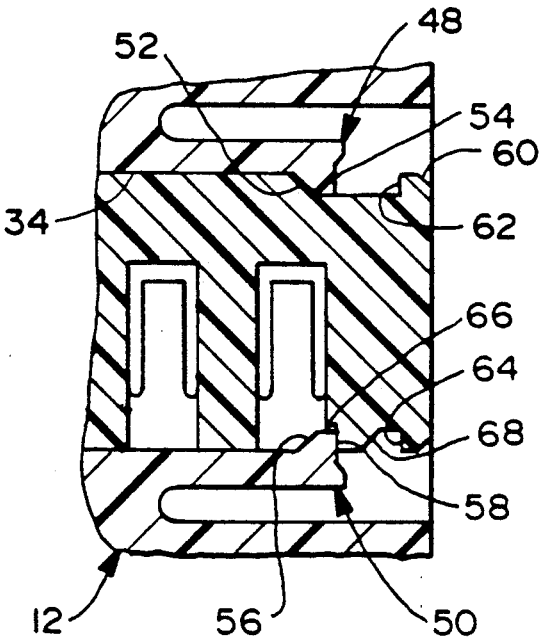
FIG. 16 is a cross sectional view similar to FIG. 14 but showing the TPA component in a second indexed position.

With further reference to FIGS. 14 and 16, it will be noted that the second TPA latch 50 is provided with an outwardly facing engagement surface 70. This surface may be engaged by an appropriate pointed or tapered tool for intentionally deflecting the TPA latch 50 away from the TPA component 36 for intentional reverse indexing of the TPA component 36 to the pre-load position. As will be explained further below, the reverse indexing of the TPA component 36 enables the TPA component 36 to be moved into the pre-load position of FIG. 13 for subsequent intentional disengagement of a damaged or defective terminal from the housing 12. Despite the intentional deflection of the second latch 50, the first latch 48 will remain undeflected, and will engage the locking primary surface 62 of the TPA component 36 in the pre-load position to prevent complete separation of the TPA component 36 from the housing 12. Thus the terminals will not inadvertently slide from the housing 12.

Figure 17:
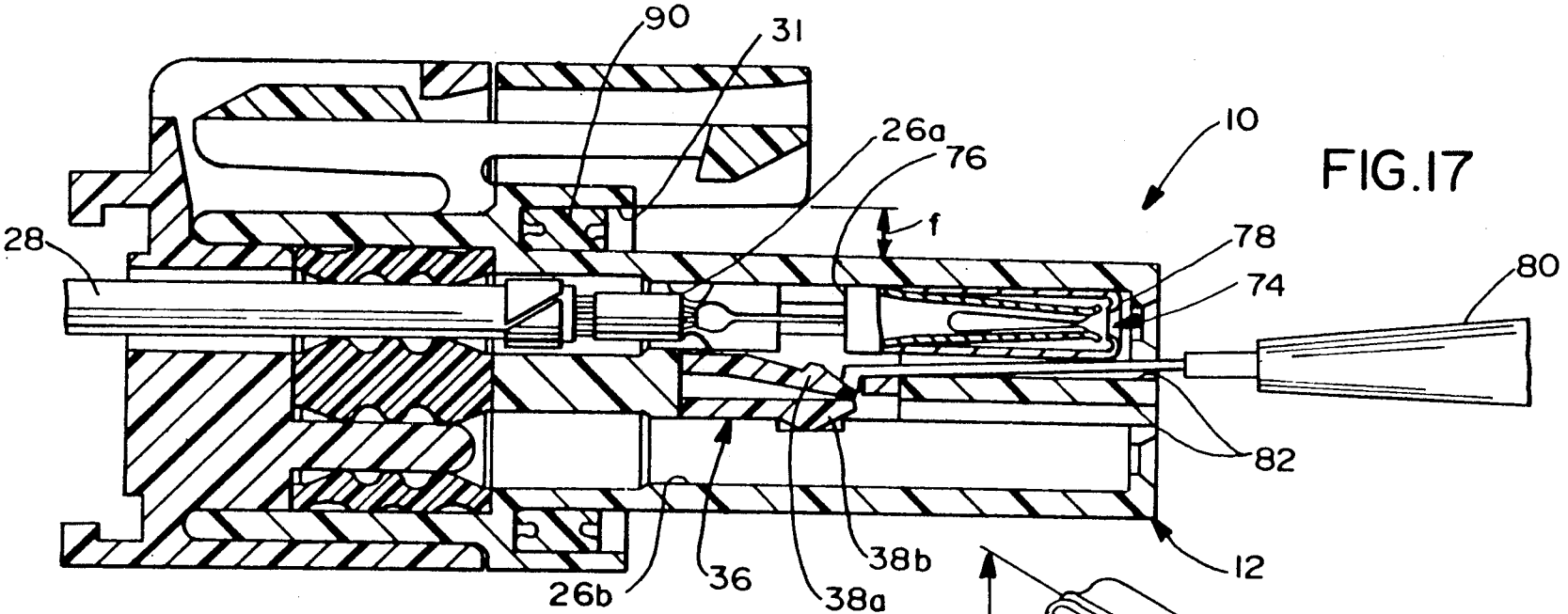
FIG. 17 is a cross sectional view taken along line 17—17 in FIG. 2.
Figure 18:
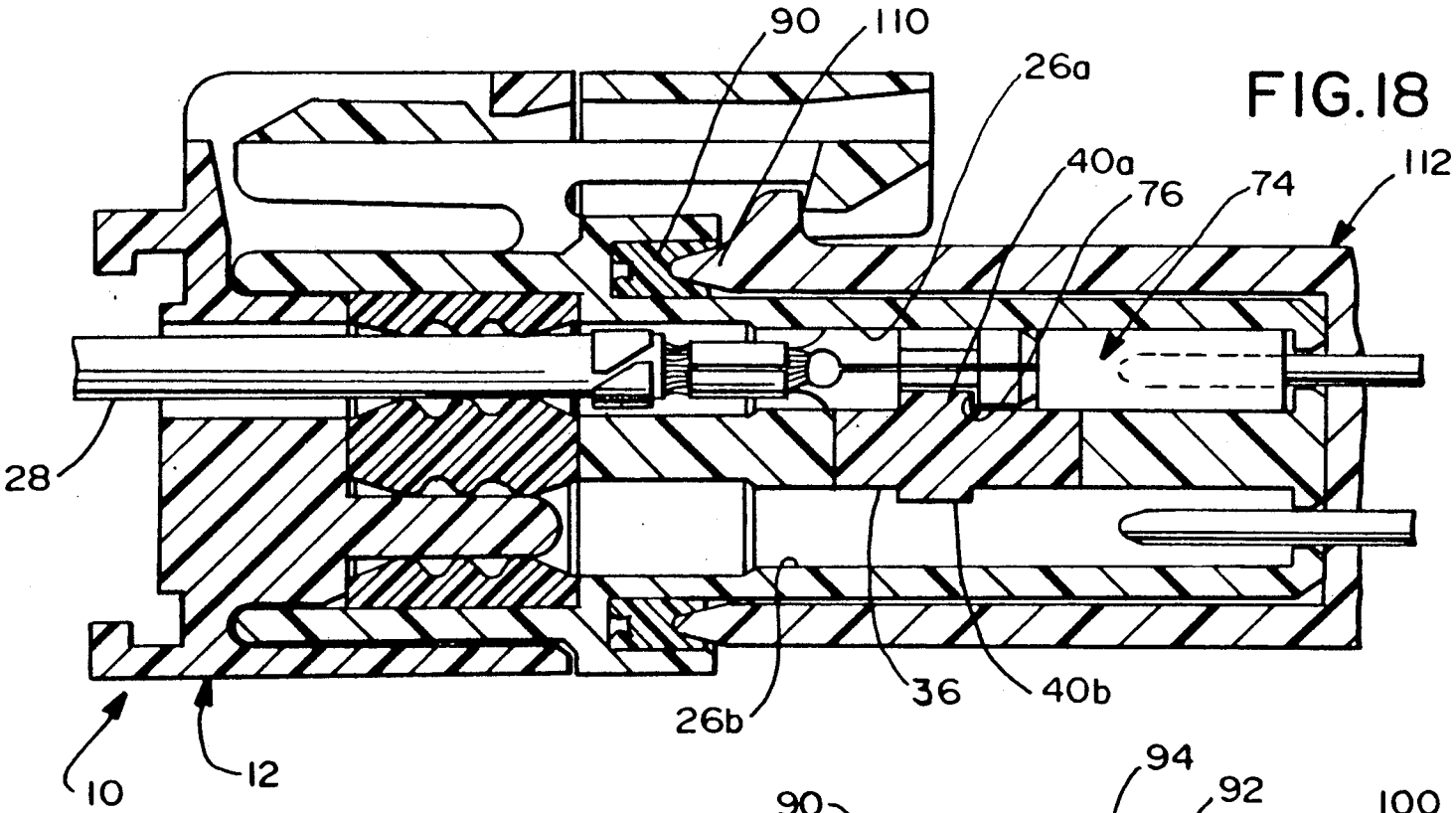
FIG. 18 is a cross sectional view similar to FIG. 17 but showing the TPA component in a second indexed position.

The relative position of the flexing primary locks 38*a*, 38*b* and the static secondary locks 40*a*, 40*b* is further illustrated in FIGS. 17 and 18. More particularly, FIG. 17 shows the TPA component 36 in the first indexed position corresponding to FIGS. 13 and 14 above. It will be noted that in this position the forwardly cantilevered flexing primary latch 38*b* extends into the terminal receiving cavity 26*b*, while the flexing primary latch 38*a*, in its undeflected condition, as shown in phantom lines, extends into the terminal receiving cavity 26*a*.

A terminal 74 having a locking notch 76 formed therein is disposed in the terminal receiving cavity 26*a* of FIG. 17. It will be appreciated that the rear to front insertion of the terminal 74 into the terminal receiving cavity 26*a*, 26*b* will cause the mating end 78 of the terminal 74 to engage the rearwardly facing ramped surface 42*a*, 42*b* of the respective flexing primary latch 38*a*, 38*b* to cause an associated inward deflection thereof. Upon sufficient advancement of the terminal 74 into the terminal receiving cavity 26*a*, 26*b*, the forwardly facing engagement surface 44*a*, 44*b* of the flexing primary latch 38*a*, 38*b* will align with the notch 76 in the terminal 74, thereby causing the flexing primary latch 38*a*, 38*b* to resiliently return toward an undeflected condition such that the engagement surface 44*a*, 44*b* thereof will engage the portion of the terminal 74 defining the notch 76 therein. This will ensure at least a temporary retention of the terminal 74 in the housing while the other terminals thereof are being inserted. The strength and pull-out forces resulting from the flexing primary latch 38*a*, 38*b* may not be adequate for the ultimate use of the connector 10. This will be particularly true on embodiments where the forwardly facing engagement surfaces define detents that are angularly aligned to the mating axis. Therefore, upon complete insertion of all terminals 74 into the housing 12, the TPA component 36 is indexed into the final looked position depicted in FIGS. 15, 16 and 18. As shown most clearly in FIG. 18, this transverse indexing of the TPA component 36 slides the static secondary locks 40*a* and 40*b* into the respective notches 76 of the terminals 74 for ensuring accurate positioning and much more positive locking retention across a major centrally disposed portion of the width of the terminals 74 in the respective terminal receiving cavities 26*a*, 26*b* of the housing 12. The notches 76 each define a length "c" substantially equal to the length of the static secondary lock 40*a*, 40*b* to ensure secure engagement of the terminal 74 relative to the housing 12. The solid construction of the static secondary locks 40*a*, 40*b* provides more permanent retention and higher pull-out force for the terminals 74 in the housing 12. It will be appreciated that the relative width and the spacing of the primary latches 38*a*, 38*b* and the secondary locks 40*a*, 40*b* is such that a portion of each notch 76 in each terminal 74 will be engaged by at least a portion of a primary latch 38*a*, 38*b* and/or a secondary lock 40*a*, 40*b* during indexing. Thus terminals will not disengage during indexing.

Returning to FIG. 17, the terminals 74 may be removed from the housing 12 when the TPA component 36 is in the pre-load position, by merely exerting a rearward pulling force on the wire 28 in embodiments where the engagement surfaces 44*a*, 44*b* of the flexing primary latches 38*a*, 38*b* are angularly aligned to the mating axis and function as detents. In embodiments where the engagement surfaces 44*a* and 44*b* are orthogonal to the mating axis and function as locks, the terminals 74 may be removed by inserting a long slender terminal removal probe 80 into an appropriately dimensioned channel 82 defined in the forward mating face 14 of the housing 12. The simple prying of the probe 80 will generate the inward flexing of the primary latch 38*a*, 38*b* to enable subsequent removal of the terminals 74 for repair or replacement. If the TPA component 36 is not in the pre-load position of FIG. 17 when the need for a repair or replacement is determined, it is merely necessary to use the probe 80 or similar tooling as described above for deflecting the second TPA latch 50 to achieve the reverse indexing into the pre-load position. Once the reverse indexing is completed, the probe 80 may be employed to deflect the appropriate flexing primary latch 38*a*, 38*b* or removal of the terminal 74.

In use, the TPA component may be slidably advanced into the keyway 34 extending between the sides 20 and 22 of the housing 12 for locked initial engagement in the pre-load position depicted in FIGS. 13, 14 and 17. This insertion of the TPA component 36 is carried out long prior to insertion of the terminals 74 and enables shipment of an assembly comprising the housing 12 and TPA component 36 to a separate location for insertion of terminals. This entirely eliminates inventory control problems and improper final assembly. The terminals 74 may merely be inserted into the respective terminal receiving cavities 26*a*, 26*b*. Each terminal 74 will be preliminarily retained in its fully seated position by the flexing primary latches 38*a*, 38*b* of the TPA component 36 which will engage the notches 76 of the respective terminals 74. Thus, no terminal 74 will displace from its fully seated position while the other terminals are being inserted. After complete insertion of all terminals 74, the TPA component 36 is indexed transversely into the final locked position depicted in FIGS. 15, 16 and 18. In this alignment the static secondary locks 40*a* and 40*b* slide into the notches 76 in the terminals 74 that are vacated by the flexing primary latches 38*a*, 38*b*, for positively preventing removal of the terminals 74 from the housing 12.

As shown most clearly in FIGS. 2, 15 and 18, the shroud 30 of the housing 12 defines a forwardly facing generally rectangular channel 31 for receiving a seal which is identified generally by the numeral 90 in FIGS. 15 and 18. The shroud 30 defines an internal width "d" as shown in FIG. 2 and an internal height "e" also shown in FIG. 2. The maximum width of the channel 31 is indicated by "f" in FIG. 2.

Figure 19:
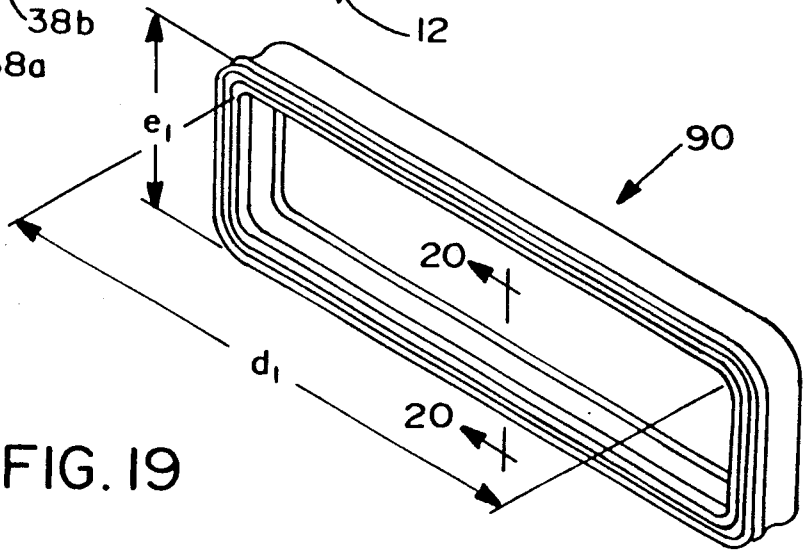
FIG. 19 is a perspective view of a seal for the connector of the subject invention.
Figure 20:
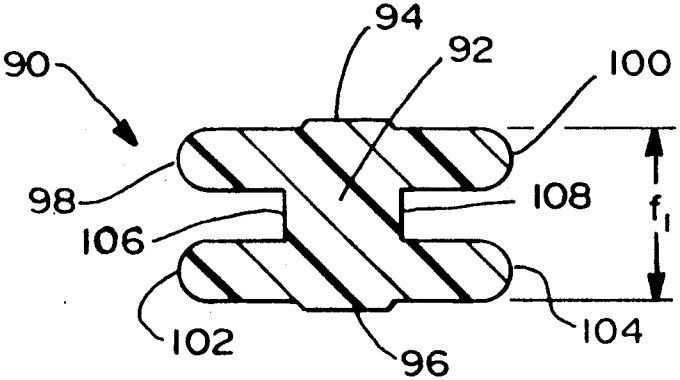
FIG. 20 is a cross-sectional view taken along line 20—20 in FIG. 19.

The seal 90 is illustrated in greater detail in FIGS. 19 and 20. The seal 90 is of generally rectangular shape which substantially conforms to the shape of the channel 31 defined by the shroud 30 of the housing 12. More particularly, the seal 90 defines an external width "$d_1$" as shown in FIG. 19 which is greater than the internal width "d" defined by the shroud 30. Similarly, the seal 90 defines a height "$e_1$" which is greater than the internal height "e" defined by the shroud 30. Thus, the seal is compressed inwardly upon insertion over the forward mating end 14 of the housing 12 and into the forwardly opening channel 32 defined by the shroud 30.

The seal 90 is of symmetrical generally H-shaped cross-section as illustrated in FIG. 20. More particularly, the seal 90 includes a central portion 92 with a continuous rib 94 extending inwardly entirely about the seal 90. Similarly, an outwardly extending rib 96 extends from the central portion 92 continuously around the outer periphery of the seal 90. The inwardly and outwardly extending continuous ribs 94 and 96 define a cross-sectional dimension "$f_1$" which is greater than the width "f" of the channel 31 as shown in FIG. 2. Thus, the central portion 92 of the seal 90 will be compressed upon insertion into the channel 31.

The seal 90 further comprises oppositely directed inner arm 98 and 100 extending from the central portion and oppositely directed outer arms 102 and 104 which also extend from the central portion 92 in generally spaced parallel relationship to the inner arms 98 and 100. Thus, a space 106 is defined between the inner arm 98 and the outer arm 102, while a similar space 108 is defined between the inner arm 100 and the outer arm 104. The spaces 106 and 108 are dimensioned to be smaller than the leading end 110 of a header 1!2 for mating with the connector !0 shown in FIG. 18.

The generally inward compression required for the seal 90 to be inserted into the channel 31 and the further inward compression of the central portion 92 of the seal 90 generated by the inner and outer ribs 94 and 96 causes a suction to be created by the space 106 facing rearwardly in the channel 31 on the housing 12. The suction functions to retain the seal 90 in the channel 31 during unmating despite any frictional forces that may exist between the seal 90 and the forward end 110 of the header housing 112. It is to be understood that the symmetrical configuration of the seal 90 does not require any directional orientation of the seal 90 prior to insertion into the channel 31. Thus, in some orientations the space 108 may be facing rearwardly on the housing to create the suction, while the space 106 will mate with the forward end 110 of the header housing 112.

While the invention has been described with respect to a preferred embodiment, it is apparent that various changes can be made without departing from the scope of the invention as defined by the appended claims.

We claim:

1. An electrical connector comprising a housing having a plurality of terminal receiving cavities and at least one keyway extending transverse to and intersecting said terminal receiving cavities; and at least one TPA component dimensioned for transverse slidable insertion into the transverse keyway of the housing and being selectively engagable in alternate pre-load and final locked positions relative to the housing, said TPA component comprising a plurality of resiliently deflectable primary latches disposed to extend into the respective terminal receiving cavities of the housing when the TPA component is in the pre-load position in the housing, said primary latches being configured to deflect during insertion of terminals into the respective terminal receiving cavities and to resiliently return toward an undeflected condition for engaging the respective terminal after complete insertion into the housing, said TPA component further comprising a plurality of static secondary locks aligned transversely with the flexing primary latches for rigidly engaging the respective terminal inserted into the housing when the TPA component is in the final locked position on the housing.

2. An electrical connector as in claim 1 wherein the resiliently deflectable primary latches of the TPA component each include a ramped surface aligned for generating deflection of the primary lock during insertion of the terminal into the respective terminal receiving cavity of the housing.

3. An electrical connector as in claim 1 wherein the housing comprises a forward mating end and a rearward end, with the terminal receiving cavities extending thereof between, the resiliently deflectable primary latches of the TPA component being cantilevered forwardly relative to the housing of the electrical connector.

4. An electrical connector as in claim 1 wherein each said primary latch of the TPA component comprises an engagement surface aligned with the terminal receiving cavities of the housing at an acute angle and disposed to engage a terminal therein, whereby a pulling force on the terminal will generate ramping forces on the engagement surface to deflect the primary latch and enable removal of the associated terminal from the housing.

5. An electrical connector as in claim 1 further comprising locking means for selectively locking the TPA component alternately in either the pre-load position in the housing or the final locked position therein.

6. An electrical connector as in claim 5 wherein the locking means comprises at least one resiliently deflectable TPA latch and wherein the TPA component comprises a first locking surface for engaging the TPA latch in the pre-load first position of the TPA component and a second locking surface for engaging the latch in the final locked position of the TPA component.

7. An electrical connector as in claim 6 wherein the TPA component comprises a ramped surface intermediate the first and second looking surfaces thereof for generating deflection of the latch to permit movement of the TPA component from the pre-load position to the final locked position in the housing.

8. An electrical connector as in claim 7 wherein the housing comprises access means for selectively accessing the TPA latch of the housing for permitting deflection of the TPA latch to enable movement of the TPA component from the final locked position to the pre-load position in the housing.

9. An electrical connector as in claim 6 wherein the locking means comprises first and second TPA latches, the first TPA latch being disposed to engage the first locking surface of the TPA component but not to engage the second locking surface thereof, the second TPA latch being disposed to engage the second locking surface of the TPA component, whereby the second TPA latch lockingly retains the TPA component in the final locked position in the housing and the first TPA latch lockingly retains the TPA component in the pre-load position in the housing.

10. An electrical connector comprising a housing having a forward mating end, a rearward end and a plurality of generally parallel terminal receiving cavities extending therebetween for receiving electrically conductive terminals, said housing further being formed to define a keyway extending generally transverse to and intersecting the terminal receiving cavities at a location on the housing spaced intermediate the forward and rearward ends, a TPA component transversely insertable and lockingly engagable in the keyway of the housing in a pre-load position and being indexable to a final locked position therein, said TPA component being configured to permit insertion of terminals into the terminal receiving cavities when the TPA component is in the pre-load position, and being configured to lockingly engage the terminals when the TPA component is indexed into the final locked position, said housing further comprising first and second TPA latches for lockingly engaging the TPA component, said TPA component being configured to lockingly engage both said TPA latches of the housing in the pre-load position of the TPA component in the housing and to engage only the second TPA latch in the final locked position of the TPA component in the housing, whereby the first TPA latch ensures retention of the TPA component in the housing after deflection of the second TPA latch for reverse indexing the TPA component from the final locked position to the preload position.

11. An electrical connector as in claim 10 wherein the TPA component comprises a plurality of deflectable primary latches for engaging each said terminal when the TPA component is in the pre-load position, said TPA component further comprising a plurality of static secondary locks for lockingly engaging each said terminal when the TPA component is in the final locked position.

12. An electrical connector as in claim 11 wherein each said flexible primary latch includes a ramped face for generating deflection of said primary latch during insertion of a corresponding terminal into said housing, each said flexible primary latch further comprising an opposed ramped engagement surface for engaging the associated terminal upon complete insertion of the terminal into the housing, said flexible primary latch being deflectable in response to pulling forces exerted on the terminal for generating ramping forces on the engagement surface to thereby enable removal of the terminal from the housing.

13. An electrical connector as in claim 11 wherein the housing further comprises a plurality of access ports extending from an external location on the housing to the keyway, each said flexible primary latch of the TPA component comprising an access surface disposed to be in alignment with the access port when the TPA component is in the pre-load position, whereby the access port enables access to the flexible primary latch for selectively disengaging the flexible primary latch from the associated terminal when the TPA component is in the pre-load position.

14. An electrical connector as in claim 10 wherein portions of the terminal receiving cavities adjacent the forward mating end of the housing are separated from one another by walls extending rigidly to external walls of the housing for ensuring adequate strength for the housing.

* * * * *